US005523521A

United States Patent [19]

Suzuki

[11] Patent Number: 5,523,521

[45] Date of Patent: Jun. 4, 1996

[54] ELECTRONIC MUSICAL INSTRUMENT INCLUDING AT LEAST TWO TONE-GENERATION ASSIGNERS

[75] Inventor: Takashi Suzuki, Hamamatsu, Japan

[73] Assignee: Yamaha Corporation, Japan

[21] Appl. No.: 177,247

[22] Filed: Jan. 4, 1994

[30] Foreign Application Priority Data

Jan. 6, 1993 [JP] Japan ..... 5-000739

[51] Int. Cl.[6] ..... G10H 1/18

[52] U.S. Cl. ..... 84/615

[58] Field of Search ..... 84/615–620, 622–633, 84/477 R, 478, DIG. 2

[56] References Cited

U.S. PATENT DOCUMENTS 4,672,876 6/1987 Sugiyama et al. ..... 84/477 R X
4,674,382 6/1987 Yorihisa ..... 84/626
4,957,552 9/1990 Iwase ..... 84/615 X
4,984,497 1/1991 Inagaki et al. ..... 84/626

*Primary Examiner*—Stanley J. Witkowski
*Attorney, Agent, or Firm*—Graham & James

[57] ABSTRACT

An electronic musical instrument provides a keyboard, a storage device, a musical tone synthesizing circuit and at least two assigners. The keyboard provides a plurality of keys to be depressed by a player, while the musical tone synthesizing circuit contains a plurality of tone-generation channels. The storage device stores a plurality of tone-generation-task assignment methods each determining which of the keys currently depressed by the player should be selected and assigned to the tone-generation channel. Each of the tone-generation channels generates a musical tone signal corresponding to the key which is assigned thereto and is depressed by the player. Each of the assigners acts in accordance with a desired tone-generation-task assignment method to be selected. Herein, each assigner selects at least one of the keys currently depressed so as to assign a selected key to at least one of the tone-generation channels. By respectively controlling those assigners, it is possible to realize a dual performance and/or a split performance.

7 Claims, 6 Drawing Sheets

AS1 AS2

| PATTERN NUMBER | FIRST ASSIGNER | | | SECOND ASSIGNER | | | |
|---|---|---|---|---|---|---|---|
| | ASSIGNMENT METHOD | NUMBER OF PRODUCING SOUNDS | TONE COLOR | ASSIGNMENT METHOD | NUMBER OF PRODUCING SOUNDS | TONE COLOR | PERFORMANCE MANNER |
| ① | HIGHER PITCH PRIOR TO LOWER PITCH | 4 | A | LOWER PITCH PRIOR TO HIGHER PITCH | 4 | B | SPLIT |
| ② | LAST PRIOR TO FIRST | 4 | A | LAST PRIOR TO FIRST | 4 | B | DUAL |
| ③ | LAST PRIOR TO FIRST | 8 | A | LAST PRIOR TO FIRST | 0 | B | NORMAL-1 |
| ④ | LAST PRIOR TO FIRST | 7 | A | LOWER PITCH PRIOR TO HIGHER PITCH | 1 | A | NORMAL-2 |
| ⑤ | LAST PRIOR TO FIRST | 7 | A | HIGHER PITCH PRIOR TO LOWER PITCH | 1 | B | SOLO TONE |

A: PIANO, B: VIOLIN

| PATTERN NUMBER | FIRST ASSIGNER (AS1) | | | SECOND ASSIGNER (AS2) | | | |
|---|---|---|---|---|---|---|---|
| | ASSIGNMENT METHOD | NUMBER OF PRODUCING SOUNDS | TONE COLOR | ASSIGNMENT METHOD | NUMBER OF PRODUCING SOUNDS | TONE COLOR | PERFORMANCE MANNER |
| ① | HIGHER PITCH PRIOR TO LOWER PITCH | 4 | A | LOWER PITCH PRIOR TO HIGHER PITCH | 4 | B | SPLIT |
| ② | LAST PRIOR TO FIRST | 4 | A | LAST PRIOR TO FIRST | 4 | B | DUAL |
| ③ | LAST PRIOR TO FIRST | 8 | A | LAST PRIOR TO FIRST | 0 | B | NORMAL-1 |
| ④ | LAST PRIOR TO FIRST | 7 | A | LOWER PITCH PRIOR TO HIGHER PITCH | 1 | A | NORMAL-2 |
| ⑤ | LAST PRIOR TO FIRST | 7 | A | HIGHER PITCH PRIOR TO LOWER PITCH | 1 | B | SOLO TONE |

A: PIANO, B: VIOLIN

FIG.2

ELECTRONIC MUSICAL INSTRUMENT INCLUDING AT LEAST TWO TONE-GENERATION ASSIGNERS

BACKGROUND OF THE INVENTION

1. Field of the Invention

The present invention generally relates to an electronic musical instrument providing a keyboard unit in which a predetermined sound can be assigned to each of keys.

2. Prior Art

As known well, there are provided several kinds of tone-generation-task assignment methods in the electronic musical instruments providing the keyboard units. For example, there are provided a so-called last-prior-to-first assignment method and a so-called higher-pitch-prior-to-lower-pitch assignment method. According to the last-prior-to-first assignment method, the last one is selected from a plurality of keys sequentially depressed; and then, a tone-generation task is firstly assigned to the key lastly depressed. In short, the lastly depressed key is selected prior to the other keys within the plural keys sequentially depressed on a last-come first-served basis, so that its sound is generated firstly prior to the other sounds corresponding to the other keys. According to the higher-pitch-prior-to-lower-pitch assignment method, one key having a higher tone pitch is selected from a plurality of keys sequentially depressed; and then, a tone-generation task is firstly assigned to that key, so that its sound is generated firstly prior to the other sounds corresponding to the other keys whose tone pitches are lower than the key selected. The above-mentioned two methods are generally employed by the electronic musical instruments.

Further, there are provided a split performance technique and a dual performance technique each of which responds to a manner of performance employed by a performer. When employing the split performance technique, the whole key area of the keyboard is divided into two areas, i.e., a higher-pitch area and a lower-pitch area, at a predetermined tone pitch. In other words, all of the keys provided in the keyboard are classified into two sections on the basis of the predetermined tone pitch. Then, the certain tone-generation-task assignment method is carried out on each of the sections. On the other hand, when employing the dual performance technique, a plurality of tone colors can be simultaneously produced from one key depression.

Meanwhile, the conventional electronic musical instrument is designed to provide the predetermined tone-generation-task assignment method and predetermined functions regarding the tone-generation tasks. Therefore, it is not possible to change them in response to the will of the performer. Moreover, each of the aforementioned split performance technique and dual performance technique requires predetermined functions which must be provided in the electronic musical instrument in advance. Therefore, if the electronic musical instrument does not provide those functions in advance, it is not possible for the user to carry out the split performance technique and dual performance technique freely.

In the split performance technique, different tone colors are respectively used for the key areas which are divided on the basis of the predetermined tone pitch. Therefore, once the split performance technique is employed, the electronic musical instrument cannot flexibly respond to each of musical tunes to be played.

SUMMARY OF THE INVENTION

Accordingly, it an object of the present invention to provide an electronic musical instrument to which a desired tone-generation-task assignment method can be set.

It is another object of the present invention to provide an electronic musical instrument which can freely carry out the split performance technique and/or dual performance technique.

The present invention relates to an electronic musical instrument in which the tone-generation task is assigned to at least one of the keys currently depressed in accordance with a predetermined rule for a priority of assignment so that the musical tone corresponding to the key to which the tone-generation task is assigned is produced. According to a fundamental configuration of the present invention, the electronic musical instrument provides a plurality of tone-generation assignment portions, a selecting portion and a control portion. Each of the tone-generation assignment portions provides its own rule for the priority of assignment, so that each of them can provide a different tone-generation-task assignment method according to which at least one key is selected among plural keys currently depressed as the key which actually works to produce a musical tone. The selecting portion selects at least one of the tone-generation assignment portions. The control portion combines the tone-generation assignment portions selected by the selecting portion so as to eventually determine the key which actually works to produce the musical tone among the plural keys currently depressed.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings:

FIG. 2 shows examples of tone-generation-task assignment patterns which are assigned for first and second assigners respectively;

DESCRIPTION OF THE PREFERRED EMBODIMENT

Figure 1:
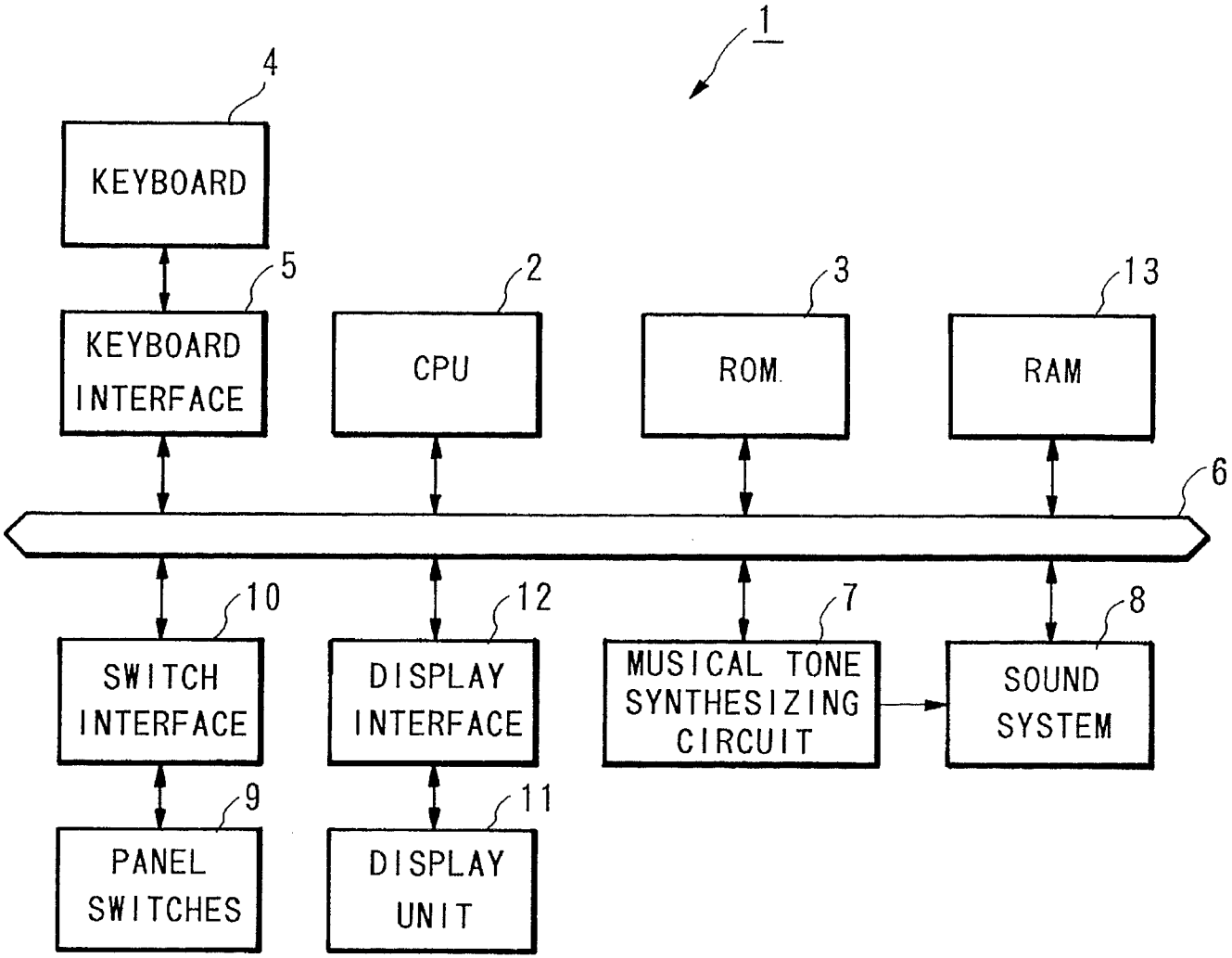
FIG. 1 is a block diagram showing an electronic configuration of an electronic musical instrument according to an embodiment of the present invention.

Next, an electronic musical instrument according to an embodiment of the present invention will be described by referring to the drawings.

[A] Hardware configuration

FIG. 1 is a block diagram showing a hardware configuration of an electronic musical instrument 1 which is designed on the basis of the present invention. In FIG. 1, a central processing unit (i.e., CPU) 2 is provided to control electronic circuits of the electronic musical instrument 1. A read-only memory (i.e., ROM) 3 stores several kinds of control data and several kinds of control programs to be executed by the CPU 1. Performing operations, i.e., manual operations applied to keys of a keyboard 4, are converted into performance information which is supplied to the CPU 2 through a keyboard interface 5 and a bus 6. Herein, the keyboard interface 5 produces the performance information in response to the key-depression/release operations effected on each key Kn (wherein "n" denotes an integral number), wherein the performance information represents a key-on event, a key-off event, a keycode and touch-related information. Next, a musical tone synthesizing circuit 7 provides a plurality of tone-generation channels (or tone-generation areas) which act in a time-division manner. On the basis of several kinds of performance data which are given from the CPU 2 through the bus 6, a plurality of musical tone signals can be simultaneously produced from the tone-generation channels in accordance with the known waveform-memory-read-out system. Those musical tone signals are supplied to a sound system 8. The sound system 8 performs predetermined filtering operations so as to remove unnecessary noise components from the musical tone signals and also impart predetermined sound effects to the musical tone signals. Thereafter, the musical tone signals are subjected to analog-to-digital conversion and amplification. Thus, musical tones corresponding to the musical tone signals are produced from speakers (not shown). In the meantime, panel switches 9 are arranged on a panel face (not shown) of the electronic musical instrument 1. Among those switches 9, there are provided a dual switch DSW and a split switch SSW. The dual switch DSW is provided to designate a dual mode, while the split switch SSW is provided to designate a split mode. Incidentally, the dual mode and split mode will be explained later. A switch interface 10 is provided to produce an operation signal corresponding to a manual operation effected on each of the switches 9. A display unit 11 is designed on the basis of the LCD technology (wherein a term "LCD" is an abbreviation for Liquid Crystal Display) and the like. The display unit 11 offers a visual display for several kinds of data which are given from the CPU 2. For example, when a certain operation mode is set for the electronic musical instrument 1 in response to a manual operation effected on the switch 9, an visual message thereof is displayed on a display screen of the display unit 11. Next, a random-access memory (i.e., RAM) 13 is used as a work area for the CPU 2. Each of storage areas provided in the RAM 13 is used for setting flags and registers which are used for storing several kinds of control data. Further, the RAM 13 provides a key-on buffer BF in which operating states of keys K1 to Kn provided in the keyboard 4 are memorized.

[B] Tone-generation-task assignment process

Next, the tone-generation-task assignment process to be performed by the CPU 2 will be described by referring to FIG. 2. Under operations of the tone-generation-task assignment process, the key depressed is related to some tone-generation channel provided in the musical tone synthesizing circuit 7. The present embodiment is characterized by providing two series of assigners, i.e., a first assigner AS1 and a second assigner AS2, in order to establish a variety of relationship between the depressed keys and tone-generation channels. Each of those assigners AS1 and AS2 utilizes three assignment items, respectively represented by terms "assignment method", "number of producing sounds" and "tone color", by which a plurality of assignment patterns can be established.

Among the above-mentioned assignment items, an item representing the assignment method corresponds to rules according to which the tone-generation channels are assigned to the keys. As the assignment method, the present embodiment employs one of the known assignment methods, i.e., higher-pitch-prior-to-lower-pitch assignment method, lower-pitch-prior-to-higher-pitch assignment method and last-prior-to-first assignment method. Another item representing the number of producing sounds designates the number of tone-generation tasks to be realized when a plurality of keys are depressed. For example, if the musical tone synthesizing circuit 7 provides eight tone-generation channels, the maximum number of tone-generation tasks to be realized becomes equal to eight. Further, it is possible to select a plurality of tone colors such as the piano and violin, so that one of them is arbitrarily designated by a tone color number TC. In an example shown in FIG. 2, each of the assigners AS1 and AS2 uses the tone color of piano, denoted by "A", or the tone color of violin denoted by "B".

There are provided five assignment patterns ① to ⑤, each of which has different contents of assignment items with respect to the assigners AS1 and AS2. In other words, the assignment patterns ① and ② respectively correspond to performance manners which are respectively described by terms "split" and "dual", while the assignment patterns ③ and ④ respectively correspond to performance manners which are respectively described by terms "normal-1" and "normal-2". Furthermore, the assignment pattern ⑤ corresponds to a performance manner which is described by a term "solo tone". Hereinafter, the contents of those performance manners will be described in turn.

① Split performance manner

In the split performance manner (see ① in FIG. 2), the higher-pitch-prior-to-lower-pitch assignment method is selected; the number of producing sounds is set at "4"; and the tone color of piano (denoted by "A") is designated in connection with the first assigner AS1. In this case, the tone-generation channels are assigned to four keys among plural keys to be depressed. Those four keys are selected in an order to the tone pitch. In other words, the key having the highest tone pitch is selected firstly; and then, the next to that key is selected secondly. Thus, the selected four keys have the tone pitches which are higher than those of the other keys among the plural keys depressed. Therefore, the tone-generation channel assigned to each key selected will create a musical tone signal using the tone color of piano.

As for the second assigner AS2, the lower-pitch-prior-to-higher-pitch assignment method is selected; the number of producing sounds is set at "4"; and the tone color of violin (denoted by "B") is designated. Herein, the tone-generation channels are assigned to four keys among plural keys depressed. In this case, the key having the lowest tone pitch is selected firstly, and the next to that key is selected secondly. Thus, the selected four keys have the tone pitches which are lower than those of the other keys among the plural keys depressed. Therefore, the tone-generation channel assigned to each key selected will create a musical tone signal using the tone color of violin.

As described above, when the split performance manner is designated, the tone color of piano is assigned to the four keys having the higher tone pitches, while the tone color of violin is assigned to the other four keys having the lower tone pitches among the plural keys depressed. Thus, regardless of the key area in which the performance of keyboard is carried out, a right hand of the performer can depress the keys to which the tone color of piano is assigned, while a left hand of the performer can depress the keys to which the tone color of violin is assigned. Therefore, in the above-mentioned split performance manner, the piano sound and violin sound can be simultaneously produced.

② Dual performance manner

In the dual performance manner (see ② in FIG. 2), the last-prior-to-first assignment method is used for both of the assigners AS1 and AS2, while the number of producing sounds is set at "4" in each of the assigners AS1 and AS2. Moreover, the tone color of piano (denoted by "A") is selected for the first assigner AS1, while the tone color of violin (denoted by "B") is selected for the second assigner AS2. Thus, it is possible to play the dual performance in which the tone colors of the piano and violin can be simultaneously produced. Since the same assignment method is employed by both of the assigners AS1 and AS2, two musical tones which have the same tone pitch but different tone colors are simultaneously produced. Thus, the number of the sounds which are simultaneously produced should be limited to four.

③ Normal-1 performance manner

In the normal-1 performance manner (or first normal performance manner, see ③ in FIG. 2), the number of producing sounds is set at "8", while the last-prior-to-first assignment method is employed in the first assigner AS1. In this case, it is possible to realize the musical performance using a single tone color, i.e., the tone color of piano (denoted by "A") under effects of the first assigner AS1, because the number of producing sounds is set at "0" in the second assigner AS2.

④ Normal-2 performance manner

In the normal-2 performance manner (or second normal performance manner, see ④ in FIG. 2), the same tone color (i.e., tone color of piano, denoted by "A") is designated in both of the assigners AS1 and AS2. In the first assigner AS1, the last-prior-to-first assignment method is employed, while the number of producing sounds is set at "7". On the other hand, in the second assigner AS2, the lower-pitch-prior-to-higher-pitch assignment method is employed, while the number of producing sounds is set at "1". Thus, the seven sounds is produced in a performance manner corresponding to the last-prior-to-first assignment method, while one sound is produced in a performance manner corresponding to the lower-pitch-prior-to-higher-pitch assignment method. Therefore, it is possible to demonstrate the characteristics unique to the performance method employed by the keyboard instrument. More specifically, the sound having the lowest tone pitch among the sounds to be produced is used as a bass sound, and the production of that sound can be assigned to the tone-generation channel in a stabilized manner.

⑤ Solo tone performance manner

In the solo tone performance manner (see ⑤ in FIG. 2), the last-prior-to-first assignment method is employed by the first assigner AS1; the number of producing sounds is set at "7"; and the tone color of piano (denoted by "A") is designated. On the other hand, in the second assigner AS2, the higher-pitch-prior-to-lower-pitch assignment method is employed; the number of producing sounds is set at "1"; and the tone color of violin (denoted by "B") is designated. In this performance manner, musical notes on a melody line are sequentially sounded like a solo tone performance by the right-hand play of the performer in the tone color of violin. Such solo tone performance manner is frequently used in electric organs.

Incidentally, the musical tone :synthesizing circuit 7 provides eight tone-generation channels CH1 to CH8. And, some of them are fixedly secured for each of the assigners AS1 and AS2 in response to its number of producing sounds. For example, in the case of the slit performance manner (see ① in FIG. 2), the first assigner AS1 supplies an instruction to generate or mute the sound to each of the tone-generation channels CH1 to CH4, while the second assigner AS2 supplies an instruction to generate or mute the sound to each of the other tone-generation channels CH5 to CH8.

[C] Software processes

Next, software processes of the electronic musical instrument 1 will be described in detail by referring to FIGS. 3, 4 and 5. Those software processes are provided to realize each of the performance manners described above. Before describing the software processes, the properties of the registers which are set in the RAM 13 will be described below.

The registers listed below are mainly used by the present embodiment.

① keycode register KC: a register in which a keycode corresponding to the tone pitch of the key depressed is written.

② velocity register KV: a register in which information representing a key-depression velocity is written.

③ tone color register TC: a register in which a value corresponding to the tone color currently designated is written. Incidentally, the above value will be expressed as a tone-color number.

④ event register KEV: a register in which information corresponding to key-depression/release events is written. Herein, a value KON is written in the register KEV when a key-on event is occurred, while a value KOFF is written in the register KEV when a key-off event is occurred.

(1) Fundamental processing

When power is applied to the electronic musical instrument 1, the CPU 2 starts to execute processes contained in a main routine, the contents of which are stored in the ROM 3. FIG. 3 is a flowchart showing the main routine.

In step S301, the CPU 2 initializes a working data area, provided in the RAM 13, in which the flags and registers are set. At that stage, predetermined initial values are respectively set to the keycode register KC, the velocity register KV and the tone color register TC. Incidentally, the value KOFF which represents that a new key-depression event is not made is written into the event register KEV. In step S302, a key-scanning process is performed so as to detect whether or not the key-depressing operation is made in the keyboard 4. In the key-scanning process, all of key switches SW1 to SWn corresponding to the keys K1 to Kn provided in the keyboard 4 are scanned sequentially.

In step S303, the CPU 2 detects one of the key switches SW1 to SWn on which the key-on event or key-off event is occurred on the basis of a result of the key-scanning process. If those events are not occurred, a result of the judgement performed in step S303 turns to "NO" so that the processing of the CPU 2 jumps to step S310. In step S310, other processes are performed. More specifically, the designation of items is performed with respect to each of the assigners AS1 and AS2. For example, when the aforementioned dual switch DSW provided in the switches 9 is operated so that the dual performance manner is designated, the CPU 2 performs the designation of the tone-generation-task assignment method, the designation of the number of producing sounds and the designation of the tone color with respect to each of the assigners AS1 and AS2. By designating the number of producing sounds, the corresponding number of the tone-generation channels are secured for each of the assigners AS1 and AS2.

After completing the above-mentioned processes of step S310, the processing of the CPU 2 returns back to step S302. Thereafter, a series of the processes of steps S302, S303 and S310 are repeatedly carried out. As described above, in the fundamental processing in which the key-depression operation and key-release operation are not carried out, several kinds of setting processes are carried out in response to the manual operations effected on the switches 9, so that data and values are set for the assigners and the like in accordance with each of the performance manners designated.

(2) Truncate process

Next, the truncate process to be carried out with respect to each of the performance manners will be described in detail.

(a) Dual performance manner

When the key-depression operation or key-release operation is carried out under the state where the dual performance manner is designated, the key-on event or key-off event is occurred; and consequently, the result of the judgement in step S303 turns to "YES" so that the processing of the CPU 2 proceeds to step S304. In step S304, the CPU 2 executes the following processes concerned with the contents of the key-depression operation.

If the key K1 is depressed, the keycode corresponding to the key K1 is written into the keycode register KC; a certain value representing the key-depressing velocity (or key-depressing pressure) applied to the key K1 is written into the velocity register KV; and the value KON representing the key-on event is written into the event register KEV. On the other hand, when the key K1 is released, the value KOFF is written into the event register KEV.

In step S306, it is judged whether or not the written contents of the event register KEV coincides with the value KON. For example, if the event detected in step S303 is the key-release event for the key K1, a result of the judgement in step S306 turns to "NO". If so, the processing branches to step S309 in which a key-off signal is sent to the tone-generation channel to which the keycode written in the keycode register KC is assigned so that the musical tone is muted.

On the other hand, if the event detected in step S303 is the key-depression event for the key K1, the result of the judgement in step S306 turns to "YES", so that the processing proceeds to step S307. In steps S307 and S308, first and second assignment processes are respectively carried out. Next, the detailed contents of those processes will be described.

Figure 4:
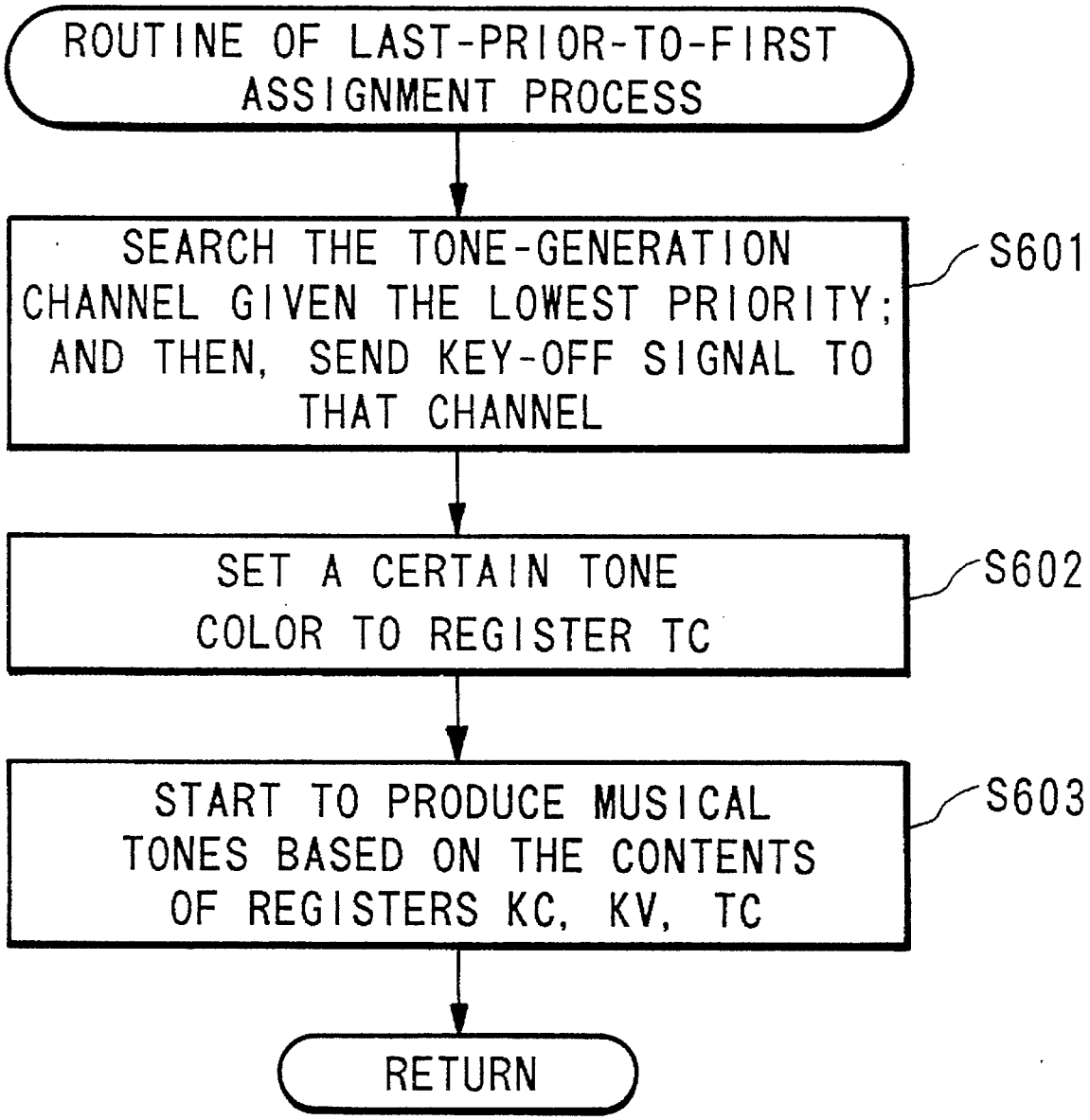
FIG. 4 is a flowchart showing a routine of last-prior-to-first assignment process.

In the case where one of the switches 9 is operated so that the dual performance manner is designated, while the certain tone-generation-task assignment pattern (see ② in FIG. 2) is designated by the first assigner AS1, the CPU 2 executes a routine of last-prior-to-first assignment process as shown in FIG. 4 when the processing of the CPU 2 reaches step S307.

In step S601 shown in FIG. 4, the CPU 2 searches the tone-generation channel having the lowest priority among the tone-generation channels CH1 to CH4 which are assigned to the first assigner AS1; and then, the CPU 2 sends a key-off signal to that tone-generation channel so as to mute its musical tone. In this case, the key on which the key-release event is occurred at first among the keys released by the performer is searched out; and then, its corresponding tone-generation channel is subjected to muting operation. In next step S602, the CPU 2 writes the tone-color number corresponding to the piano into the tone color register TC in order that the tone-generation channel is occupied in producing the musical tone in the tone color of piano. In step S603, a key-on signal together with the contents of the registers KC, KV and TC are sent to the tone-generation channel which has been subjected to muting operation in step S601. Thus, the tone-generation channel starts to produce a musical tone signal, which is supplied to the sound system 8 so that the corresponding musical tone will be produced. Thereafter, when the routine of last-prior-to-first assignment process is completed, the processing of the CPU 2 proceeds to step S308 shown in FIG. 3.

When the processing of the CPU 2 reaches step S308 (see FIG. 3), the CPU 2 executes a routine of second assignment process. Herein, in order to realize the tone-generation-task assignment pattern which is set in the second assigner AS2, the aforementioned routine of last-prior-to-first assignment process is carried out again. In step S601 of this routine (see FIG. 4), the CPU 2 scans the tone-generation channels CH5 to Ch8, which are assigned for the second assigner AS2, so as to find out the tone-generation channel whose priority is the lowest; and then, the key-off signal is sent to that channel so as to mute its musical tone. In next step S602, in order to set the tone color of violin for the tone-generation channels CH5 to CH8, the corresponding tone-color number is written into the tone color register TC (see ② in FIG. 2). In step S603, the key-on signal together with the written contents of the registers KC, KV and TC are sent to the tone-generation channel whose musical tone has been muted in step S601. Thus, the musical tones having the tone colors of the piano and violin are simultaneously produced from the sound system 8 in the same tone pitch corresponding to the key K1 depressed. In short, the dual performance manner is realized.

(b) Split performance manner

Figure 3:
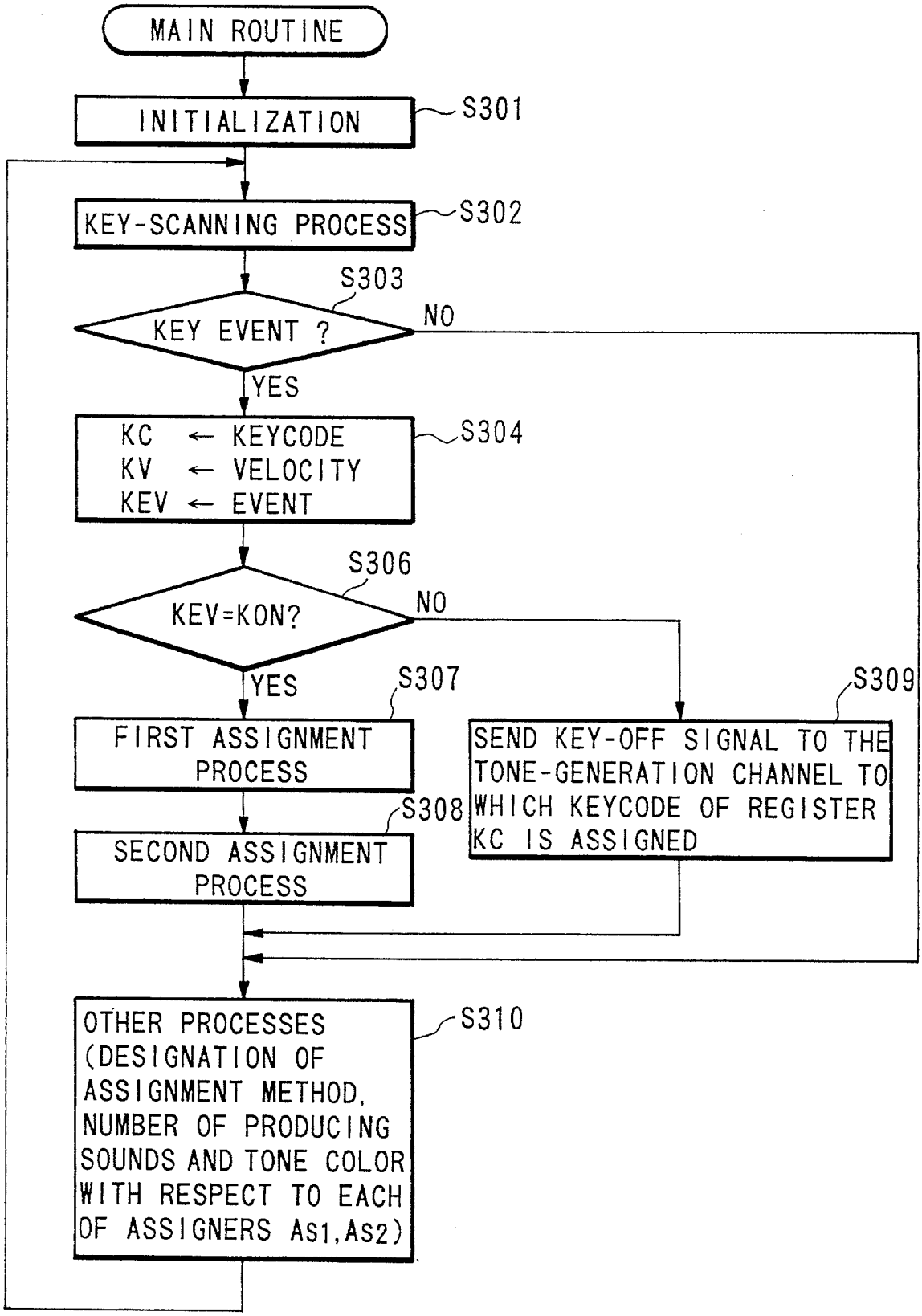
FIG. 3 is a flowchart showing a main routine.

Next, when one of the switches 9 is operated so that the split performance manner (see ① in FIG. 2) is designated, the predetermined setting operation is carried out in step S310 in the main routine shown in FIG. 3. As for the first assigner AS1, the higher-pitch-prior-to-lower-pitch assignment method is employed; the number of producing sounds is set at "4"; and the tone color of piano (denoted by "A") is designated. As for the second assigner AS2, the lower-pitch-prior-to-higher-pitch assignment method is employed; the number of producing sounds is set at "4"; and the tone color of violin (denoted by "B") is designated. Incidentally, the following description of the split performance manner deals with an event in which the key K9 is newly depressed under the state where the keys K1 to K8 are currently depressed.

Figure 5:
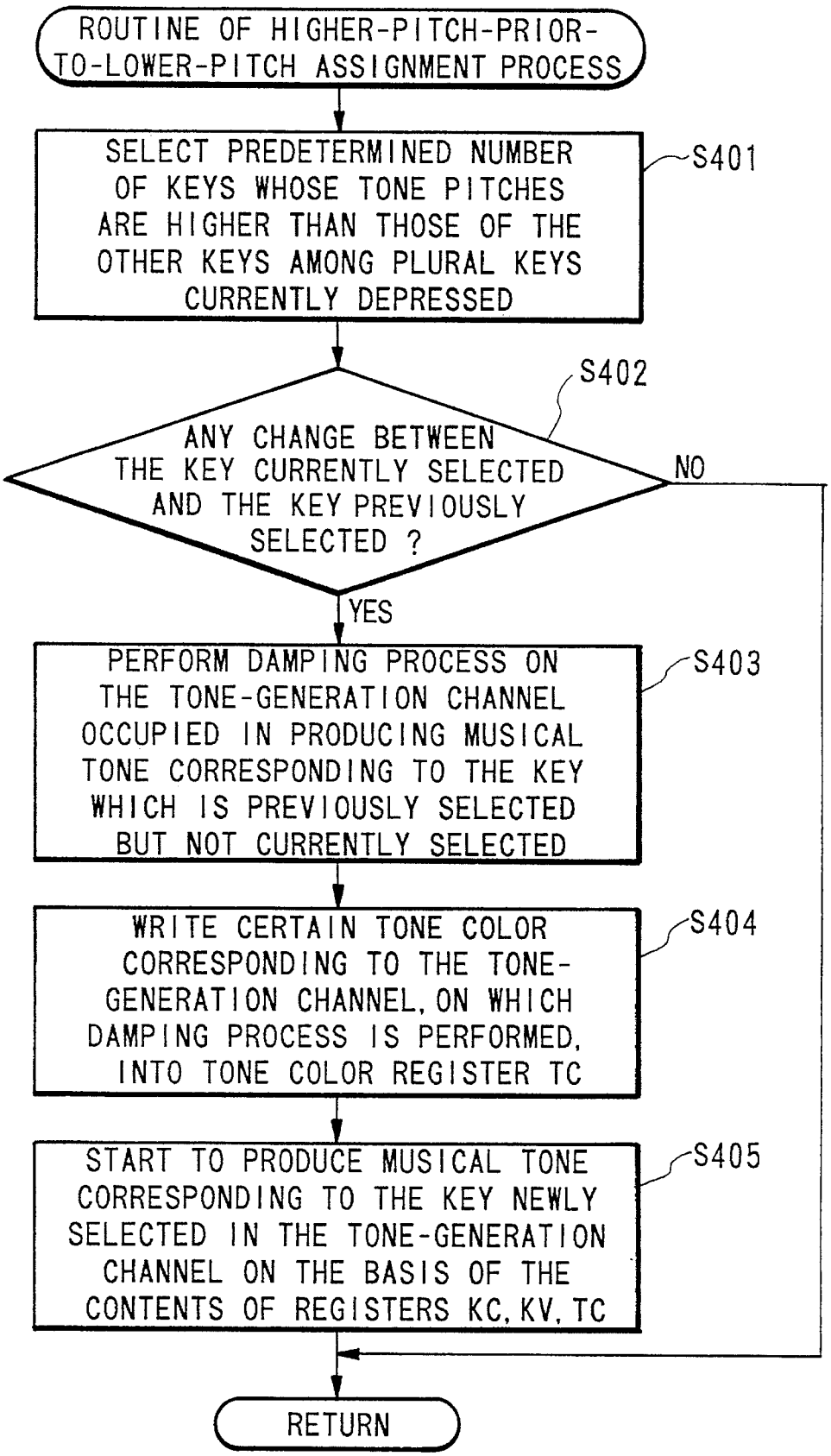
FIG. 5 is a flowchart showing a routine of higher-pitch-prior-to-lower-pitch assignment process.

In this event, when the processing of the CPU 2 proceeds to step S307 in the main routine shown in FIG. 3, a routine of higher-pitch-prior-to-lower-pitch assignment process as shown in FIG. 5 is carried out. In step S401, the predetermined number of keys (e.g., four keys) whose tone pitches are higher than those of the other keys are searched from the keys K1 to K9 all of which are currently depressed. Herein, based on the contents of the key-on buffer BF, the top four keys whose tone pitches are higher than those of the other four keys are selected for the tone-generation tasks among the keys K1 to K9 which are currently depressed. In step S402, it is judged whether or not any change is occurred between the key currently selected and the key which has been previously selected. For example, if the key K9 which is lastly depressed has the tone pitch which is the fifth or less from the top in the tone pitches of the depressed keys so that the four keys selected from the keys K1 to K8 are not changed by the key-depression event of the key K9, a result of the judgement in step S402 turns to "NO", so that the execution of the routine of higher-pitch-prior-to-lower-pitch assignment process is terminated.

On the other hand, when the tone pitch of the key K9 lastly depressed is within the top four tone pitches among the keys K1 to K9, the result of the judgement in step S402 turns to "YES" so that the processing proceeds to step S403. In step S403, in order to assign the new tone-generation task for the key K9, the CPU 2 instructs the musical tone synthesizing circuit 7 to perform a damping process on the tone-generation channel CHn to which the fifth tone pitch of the key among the tone pitches of the keys currently depressed is set. Thus, the musical tone signal produced from that channel is rapidly damped. In step S404, the tone color of the above tone-generation channel which is selected in accordance with the higher-pitch-prior-to-lower-pitch assignment method is written into the tone color register TC. In this case, the tone color of piano (denoted by "A") is written into the register TC. Then, the processing proceeds to step S405 in which the key-on signal together with the written contents of the keycode register KC, the velocity register KV and the tone color register TC are sent to the tone-generation channel in which the musical tone signal has been rapidly damped in step S403. Thus, the tone-generation channel starts to produce a new musical tone signal, so that the corresponding musical tone is sounded from the sound system 8. Thereafter, the CPU 2 terminates the execution of the routine of higher-pitch-prior-to-lower-pitch assignment process.

Next, when completing the above-mentioned first assignment process, the second assignment process (see step S308) is carried out with respect to the split performance manner.

Figure 6:
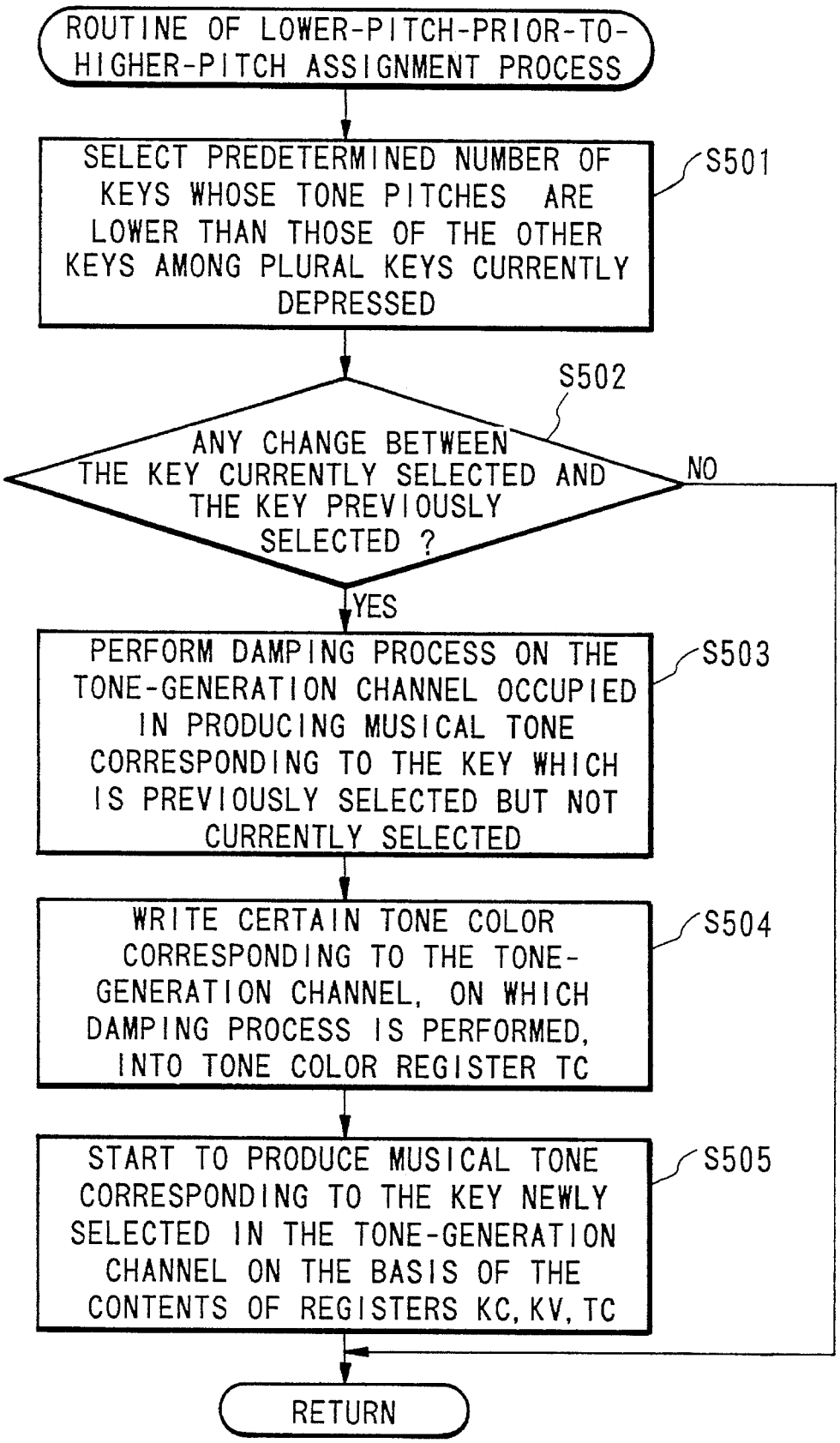
FIG. 6 is a flowchart showing a routine of lower-pitch-prior-to-higher-pitch assignment process.

In this case, a routine of lower-pitch-prior-to-higher-pitch assignment process as shown in FIG. 6 is carried out.

For example, in the case where the key K9 is newly depressed under the state where the key K1 to K8 are currently depressed, when the processing of the CPU 2 proceeds to step S501, the predetermined number of keys whose tone pitches are lower than those of the other keys are selected. Herein, the four keys having the tone pitches which are within the bottom four tone pitches among the keys K1 to K9 currently depressed are selected in accordance with the lower-pitch-prior-to-higher-pitch assignment method. In next step S502, it is judged whether or not any change is occurred between the key currently selected and the key which has been previously selected. If the key K9 newly depressed has the tone pitch which is within the bottom four tone pitches among the keys K1 to K9, one of the four keys which have been previously selected from the keys K1 to K8 should be replaced by the key K9. If so, a result of the judgement in step S502 turns to "YES", so that the processing proceeds to step S503.

In step S503, the CPU 2 instructs the musical tone synthesizing circuit 7 to perform a damping process on the tone-generation channel CHn to which the fifth tone pitch from the lowest tone pitch among the keys K1 to K9 is set. Thus, the musical tone signal produced from that channel is rapidly damped. In next step S504, in order to set the tone color of violin to the above tone-generation channel, the corresponding tone-color number is set to the tone color register TC. Then, the processing proceeds to step S505 in which the key-on signal together with the written contents of the registers KC, KV and TC are sent to the tone-generation channel CHn in which the musical tone signal has been rapidly damped. Thus, the tone-generation channel CHn starts to produce a new musical tone signal; and consequently, the corresponding musical tone is sounded from the sound system 8.

As described heretofore, when the split performance manner is designated, the tone-generation channel to which the tone-generation task is assigned in accordance with the higher-pitch-prior-to-lower-pitch assignment method by the first assignment process is working to produce the musical tones in the tone color of piano, while another tone-generation channel to which the tone-generation task is assigned in accordance with the lower-pitch-prior-to-higher-pitch assignment method by the second assignment process is working to produce the musical tones in the tone color of violin. Thus, the split performance can be realized.

(c) Normal-1 performance manner

Next, when the normal-1 performance manner (see ③ in FIG. 2) is designated, the predetermined setting operations are performed in step S310. In this case, the last-prior-to-first assignment method is employed for both of the first assigner AS1 and second assigner AS2. Further, as for the first assigner AS1, the number of producing sounds is set at "8"; and the tone color of piano is set. As for the second assigner AS2, the number of producing sounds is set at "0"; and the tone color of violin is set. In this case, the CPU 2 executes the aforementioned routine of last-prior-to-first assignment process as shown in FIG. 4 when the processing thereof reaches step S307 shown in FIG. 3. Thus, the tone-generation tasks are respectively assigned to the eight tone-generation channels CH1 to CH8 in accordance with the last-prior-to-first assignment method; and then, those channels are occupied in producing the musical tones having the same tone color of piano.

(d) Normal-2 performance manner

When the normal-2 performance manner (see ④ in FIG. 2) is designated, the predetermined setting operations are performed for the assigners AS1 and AS2. As for the first assigner AS1, the last-prior-to-first assignment method is employed; the number of producing sounds is set at "7"; and the tone color of piano (denoted by "A") is designated. As for the second assigner AS2, the lower-pitch-prior-to-higher-pitch assignment method is employed; the number of producing sounds is set at "1"; and the tone color of piano is designated. Thus, in step S307 (see FIG. 3), the CPU 2 executes the routine of last-prior-to-first assignment process as shown in FIG. 4, so that the tone-generation tasks are respectively assigned to the seven tone-generation channels CH1 to CH7, which are provided for the first assigner AS1, in accordance with the last-prior-to-first assignment method. In step S308, the CPU 2 executes the routine of lower-pitch-prior-to-higher-pitch process as shown in FIG. 6, so that the tone-generation task corresponding to the key whose tone pitch is the lowest among the plural keys currently depressed is assigned to the tone-generation channel CH8 which is provided for the second assigner AS2. Therefore, the tone-generation channel CH8 will be occupied in producing the bass sound. In short, when the normal-2 performance manner is designated, the limited number of the tone-generation channels are occupied in producing the bass sounds. Even if a plenty of tone-generation tasks are assigned to the electronic musical instrument having the limited number of tone-generation channels, the electronic musical instrument will never fail to produce the bass sounds when being set in the normal-2 performance manner, because the bass sounds are the important notes in terms of the musical performance.

(e) Solo tone performance manner

When the solo tone performance manner (see ⑤ in FIG. 2) is designated, the setting manner of the first assigner AS1 is identical to that in the aforementioned normal-2 performance manner. However, as for the second assigner AS2, the higher-pitch-prior-to-lower-pitch assignment method is employed; the number of producing sounds is set at "1"; and the tone color of violin is designated. In this case, when reaching step S308, the CPU 2 executes the routine of higher-pitch-prior-to-lower-pitch assignment process as shown in FIG. 5. Thus, the tone-generation task corresponding to the key whose tone pitch is the highest among the plural keys currently depressed is assigned to the tone-generation channel (e.g., CH8) which is provided for the second assigner AS2. Thus, the musical notes on the melody line (i.e., the highest tone pitch among the tone pitches of the plural keys simultaneously depressed) are sounded in the tone color of violin, while the other musical notes corresponding to the other keys depressed are sounded in the tone color of piano. In short, the solo tone performance manner can be realized.

As described heretofore, the electronic musical instrument according to the present invention provides a plurality of assigners and arbitrarily combines some of them, wherein each of the assigners performs a different tone-generation-task assignment process. Therefore, it is possible to select the optimum assignment pattern for each of the assigners, while by changing the tone color assigned to each assigner, it is possible to realize the dual performance, split performance and the like.

Incidentally, the assignment methods employed in the present embodiment are merely the examples to be used by the present invention. Therefore, it is possible to use the other known assignment methods such as the first-prior-to-last assignment method.

Further, when it is determined that the number of the key-depression events to be occurred simultaneously is one, the present embodiment can be re-designed such that only one assigner is activated in response to the key-depression event.

If the same assignment pattern is used for both of the two assigners, the present embodiment produces the same musical tone double. In that case, the present embodiment can be re-designed such that one of the musical tones is slightly changed in the tone color or the coefficient of the filtering operation applied to one of the musical tones is changed so as to obtain an ensemble effect.

In the present embodiment, the priority used in step S601 in FIG. 4 is determined based on the key Kn whose key-depression event is the oldest among the plural keys sequentially depressed. However, this is not restrictive. In other words, the present embodiment can be easily re-designed such that the priority is determined based on the key corresponding to the envelope waveform whose level is the most damped among the plural keys depressed. Or, the present embodiment can be also re-designed such that the priority is determined based on the key Kn whose key-release event is the oldest.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument comprising:

tone information generating means for generating tone information;

storage means for storing a plurality of tone-assignment methods, each designating a specific method by which a generation of tone is assigned to a tone-generation channel based on the tone information;

musical tone synthesizing means including a plurality of tone-generation channels, each of which generates a musical tone signal corresponding to the tone information;

selecting means for selecting at least one of the plurality of tone-assignment methods; and at least two tone-generation assignment means, responsive to said tone information, for independently assigning the tone information to a tone-generation channel in accordance with the tone-assignment method selected by the selecting means.

2. An electronic musical instrument according to claim 1 wherein each of the plurality of tone-assignment methods also determines a number of the tone-generation channels to be managed by each of the tone-generation assignment means such that the number determined is limited by a number of the plurality of the tone-generation channels.

3. An electronic musical instrument according to claim 1 wherein the tone-assignment method selected for one of the tone-generation assignment means is different from that to be selected for the other of the tone-generation assignment means.

4. An electronic musical instrument according to claim 1 wherein the tone-assignment method selected for one of the tone-generation assignment means is the same as that to be selected for the other of the tone-generation assignment means.

5. An electronic musical instrument according to claim 1 wherein the tone generation assignment means secures a part of the tone-generation channels, so that a tone-generation assignment is made within a range corresponding to a secured part of the tone-generation channels.

6. An electronic musical instrument according to claim 1 wherein the tone information is information regarding a key depressed.

7. An electronic musical instrument comprising:

tone information detecting means for detecting tone information;

storage means for storing a plurality of tone-assignment methods, each method designating a specific method by which a generation of tone is assigned to a tone-generation channel;

selecting means for selecting at least a first and a second tone assignment method from said plurality of tone assignment methods stored in said storage means;

musical tone synthesizing means including a plurality of tone-generation channels, for generating a musical tone signal corresponding to the tone information;

first assignment means for assigning the tone information to the tone-generation channel in accordance with a first tone-assignment method; and second assignment means for assigning the tone information to the tone-generation channel in accordance with a second tone-assignment method.

* * * * *